United States Patent [19]

Neou

[11] Patent Number: 4,880,135

[45] Date of Patent: Nov. 14, 1989

[54] EVAPORATIVE EMISSION CONTROL OF LIQUID STORAGE TANKS USING BELLOW SEALING SYSTEMS

[76] Inventor: In-Meei Neou, 3444 Murdoch Ct., Palo Alto, Calif. 94306

[21] Appl. No.: 73,457

[22] Filed: Jul. 15, 1987

[51] Int. Cl.[4] ..... B65D 25/00

[52] U.S. Cl. ..... 220/85 VS; 220/216; 220/85 S

[58] Field of Search ..... 220/85 S, 85 VS, 85 V, 220/22.6, 22.1, DIG. 24, 216, 218, 227

[56] References Cited

U.S. PATENT DOCUMENTS

| | | | |
|---|---|---|---|
| 3,617,034 | 11/1971 | Skinner | 220/85 VS |
| 3,693,825 | 9/1972 | Richman | 220/227 |
| 4,163,505 | 8/1979 | Gunther | 220/216 |
| 4,254,887 | 3/1981 | Bold | 220/216 |
| 4,705,185 | 11/1987 | Barbillat | 220/216 |

FOREIGN PATENT DOCUMENTS

| | | | |
|---|---|---|---|
| 0793825 | 1/1981 | U.S.S.R. | 220/85 VR |

*Primary Examiner*—Stephen Marcus
*Assistant Examiner*—Gilbert W. Reece
*Attorney, Agent, or Firm*—Flehr, Hohbach, Test, Albritton & Herbert

[57] ABSTRACT

The invention relates to the installation of a vapor reduction and isolation system in a liquid storage tank. A flexible bellow divides the interior of the storage tank into two separate compartments: a closed liquid-vapor space and an externally vented space. Changes in liquid level, temperature, pressure, etc., are automatically compensated by extensions and contractions of the bellow, keeping the pressure in the tank constantly at atmospheric pressure without resort to venting to the atmosphere or to a carbon canister in the current vapor recovery system. The bellow is also used for sensing and controlling liquid level and for compensating for temperature and pressure changes.

6 Claims, 2 Drawing Sheets

EVAPORATIVE EMISSION CONTROL OF LIQUID STORAGE TANKS USING BELLOW SEALING SYSTEMS

FIELD OF INVENTION

The invention relates to a vapor reduction and isolation system for controlling evaporative emission from liquid storage tanks by installing a flexible, self-adjusting bellow inside the tank to separate the liquid-vapor space from the externally vented air space and keep the pressure inside the tank constantly at atmospheric pressure at any liquid level, temperature, ambient pressure, etc.. The bellow can also be used for sensing or controlling liquid level.

BACKGROUND OF THE INVENTION

Escaping vapors of volatile fuel and chemical fluids in mobile and stationary storage tanks is not only a big loss of raw materials, but also a major source of air pollution, fire and explosion hazards, etc.

In the case of automobile engines without evaporative emission control, almost 20% of the gasoline is lost to the atmosphere by way of vaporization and breathing in the fuel storage tank and the carburetor bowl. At high temperature or low ambient pressure at high elevation, a larger percentage of vapors in the fuel tank and carburetor bowl goes out into the atmosphere through the external vents. When fuel is withdrawn from the tank while the engine is running, or when the vapors condense as the temperature drops, fresh air comes in through the vents to take up the vacated space, and the moisture-laden air may form ice in the fuel system at low temperature and even change the characteristics of the fluid, such as alcohol, which is readily miscible with water.

Since 1971, all motor vehicles in the U.S. are required by law to have a vapor recovery system. It consists of carbon canisters, liquid-vapor separators, vent and purging lines, etc.. When the engine stops, vapors in the fuel tank and the carburetor bowl are absorbed by the activated carbon in the canister. As soon as the engine is started, the vacuum in the manifolds draws in fresh air through the carbon canister and the vapor is purged into the engine for burning. The system is complicated and needs frequent cleaning or replacing of the air filter, the activated carbon, etc.. Besides, exchange of vapors and external air still takes place in the carbon canister.

The petroleum and chemical industries, in an effort to combat evaporative or boil-off loss of raw materials and leaking of deadly toxic fumes from giant storage tanks above or under the ground, have come up with various proprietary designs. The widely used method is the installation of a floating roof inside the vented fixed roof of the storage tank. A giant metal pan or deck sometimes aided by floats and pontoons, rides freely on the surface of the liquid, and the annular space between the floating roof and the tank shell is sealed by means of sliding mechanical shoes, flexible elastomeric scuff-bands, foam-filled seals, etc. While the floating roof greatly reduces the area of surface of the fluid exposed to the atmosphere, exchange of fuel vapors and external air still takes place in the sliding contact seals. While the system may be useful for fluids having low vapor pressure in stationary storage tanks, it is not effective for stopping vapor emission of fluids having high vapor pressures in a storage tank constantly in unsteady motion, wherein sloshing and surging of the fluid, and heaving, rolling and pitching of the free-floating deck can quickly destroy the effectiveness of the sliding contact sealing.

During the refueling operation at a filling station, gasoline from the filler nozzle splashes down to the fluid in a conventional fuel tank and the rising fluid drives the fumes out into the atmosphere. In order to combat the air pollution at busy filling stations, efforts have been made in modifying the dispensing units and the nozzles or using a double-walled hose in which one passage is used for fuel supply and the other for drawing the vapors in the fuel tank into the station's underground storage tank.

In recent years, leaking of deadly toxic fumes and liquids from chemical tanks into the atmosphere and underground water not only becomes a serious threat to human health and environmental quality, but also hinders the rapid development of high technology industries.

SUMMARY OF THE INVENTION

The invention relates to the installation of a flexible bellow sealing system inside a liquid storage tank in motion or at rest. The bellow has its open-end secured to the upper or lower portion of the storage tank and its closed-end or cover resting on the fluid or springs. It divides the interior of the tank into two separate compartments: a closed liquid-vapor space and an externally vented air space. Changes in liquid levels, temperature, pressure, etc. are automatically compensated by extensions and contractions of the bellow, keeping the tank pressure constantly at atmospheric pressure without the need for venting to the atmosphere or to a carbon canister in a vapor recovery system. It also prevents the moisture-laden fresh air from entering the storage tank to form ice in the fuel system or alter the characteristics of the fluid. The reduction of the sealed vapor space to a small fraction of the vapor space in a conventional liquid storage tank greatly reduces the evaporative loss of vapors. The moving bellow can also be used for sensing and controlling liquid levels, compensating for temperature and pressure changes, etc. The vapor reduction and isolation system may also be adapted for controlling vapor emissions from storage tanks containing pressurized or liquefied fuels and chemicals if heavy-duty bellows are used. The design is simple, compact and effective for reducing or eliminating evaporative loss of unused materials, air pollutions, fire and explosion hazard, etc.

BRIEF DESCRIPTION OF THE DRAWINGS

The invention will be described with reference to the drawings in which.

Similar numerals refer to similar elements throughout the drawings.

DETAILED DESCRIPTION OF THE INVENTION

Figure 1:
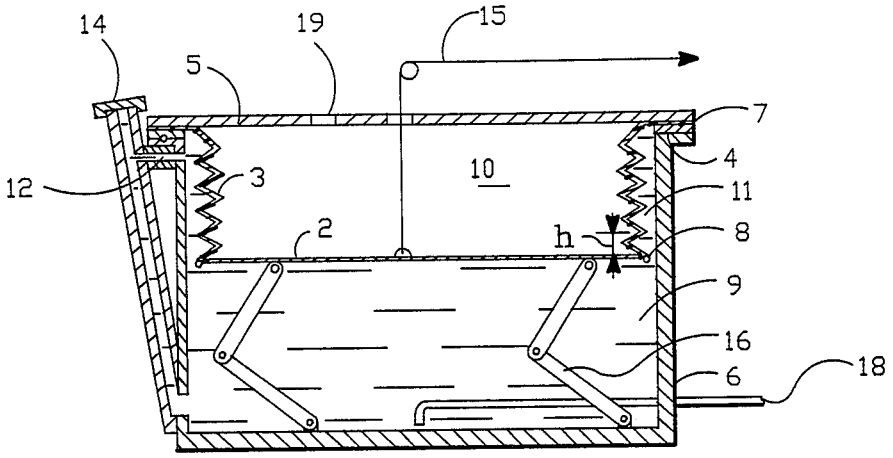
FIG. 1 is a vertical sectional view of a bellow sealing system in a liquid storage tank, taking in the middle of the long side of a rectangular box or a standing-up cylinder.

FIG. 1 shows a vertical sectional view of a liquid storage tank having a bellow sealing system. The bellow is like an inverted top hat, open at the top and closed at the bottom by a cover 2, and has a highly flexible accordion-type corrugated or convoluted side wall 3. The corrugated wall may be formed by blow-molding, bonding of two-ply highly flexible, noncorrosive thin plastic or rubber sheets reinforced by helically wound fine spring steel wires, etc.. The flange 4 at the top of the bellow is firmly secured between the roof 5 and the shell 6 of the tank with a gasket 7 between the flanges of the bellow and the shell of the tank. The bottom cover 2 has several protruded points or "spacers" 8 to position the bellow near the center of the tank. The lower portion of the bellow is submerged in the liquid 9, creating a buoyancy force to support the weight of the floating bellow and counteract the "spring force" of the bellow. The buoyancy force is equal to the weight of the liquid displaced by the submerged portion of the floating bellow, which is equal to the product of the effective area of the cover 2, the height h of the free surface of the fluid above the cover 2 and the specific weight of the liquid. The floating bellow divides the interior space above the liquid in the tank into two separate chambers: an air space 10 vented to the atmosphere through air vent 19 and a closed annular vapor space 11 between the corrugated wall 3 of the bellow and the shell 6 of the tank. A cross-over vent tube 12 connects the vapor spaces of the tank and the filler tube 13 which is normally closed by a filler cap 14. As the vapor space in the tank, including that of the filler tube, is now only a small fraction of the air space 10 which was otherwise filled with vapors in a conventional storage tank, the maximum loss of vapors to the atmosphere during the filling operation is greatly reduced. Any changes in the level of the liquid, pressure, temperature, etc., are automatically compensated for by the extensions and contractions of the bellow, keeping the pressure in the tank constantly in equilibrium with the atmospheric pressure. The floating bellow not only hermetically seals the liquid and vapors off from the atomsphere but also keeps the moisture-laden air from entering the closed vapor-liquid space in the tank to form ice in the fuel supply system or alter the characteristics of the liquids readily miscible with or disolvable in water. The bellow also helps prevent flammable fuels from spilling out of the tank and bursting into flame when the motor vehicle is turned upside down.

The floating bellow may as well be used as a sensing device to replace the conventional float for monitoring the amount of fuel left in the tank. A taut flexible wire 15 may be attached to the center of the floating bellow cover 2 and connected to a conventional "sending unit" (not shown in FIG. 1). The rise and fall of the liquid level and hence the floating bellow cover 2 change the positions of a sliding contact on a variable resistor in the sending unit which sends the changing electric current onto a fuel gauge on the dashboard.

To combat the sloshing of fluid and the vibration and sway of the floating bellow, articulated perforated plates 16 are used to replace conventional rigid baffle plates fixed on the bottom of the tank. They are hinge-jointed to the floating cover 2 and the bottom of the tank. Additional damping of vibration is provided by the restricted flow of air through the vents 19.

The fuel tank has a conventional drain plug 17 and a screened pick-up tube 18 leading to the fuel pump.

During the refueling operation at the filling station, liquid fuel flows from the filler nozzle into the filler tube 13 of the fuel tank of the motor vehicle and enters the tank quietly near its bottom without causing splashing and fuming. The rising liquid pushes the floating bellow up and drives vapors in the vapor space 11 though the cross-over vent tube 12 into the filler tube and finaly out to the atmosphere. Since the combined vapor spaces in the fuel tank and the filler tube is only a small fraction of the almost empty storage tank, loss of vapors and pollution of air at busy filling stations can be greatly reduced. When the liquid rises to a certain predetermined level, the rotary pump in the station's dispensing unit automatically stops delivering the liquid into the fuel tank, leaving some spare space in the tank for additional contraction of the bellow to accommodate thermal expansion of the liquid and vapors. As vapor or gas in general has a much larger volumetric coefficient of thermal expansion than that of the liquid, and the amount of vapor produced in the sealed annular vapor space 11 is now greatly reduced, the required expansion space in the fuel tank can accordingly be greatly reduced (conventional expansion tank occupies 10–12% of the volume of the storage tank).

When the rotary pump in the dispensing unit is started, a vacuum is created in the intake side of the pump and air in the conventional externally vented underground storage tank at the filling station forces the fuel into the pump. On the discharge side of the rotary pump, air separator and sump are needed to remove vapors and air from the liquid before the liquid fuel is sent on to the fuel supply line and the filler nozzle. If the underground storage tank is equipped with a floating bellow sealing system, the atmospheric pressure on one side of the bellow barrier can push the liquid on the other side of the bellow out into the rotary pump without the need of air-separator, sump, etc. for de-aerating the liquid fuel.

Similarly, if fuel storage tanks used in fuel injection engines, etc., are equipped with the bellow sealing systems many of the bulky and troublesome equipment for separating air, vapor and water from the liquid on the low pressure intake sides can be eliminated or reduced in sizes.

The conventional carburetor float bowl in a gasoline engine is a small fuel storage tank, having a floatactuated needle valve in the inlet tube to regulate the flow of the fuel from the fuel pump and maintain a constant fuel level in the bowl. Since the float bowl is externally vented, vapors can escape into the atmosphere.

Figure 2:
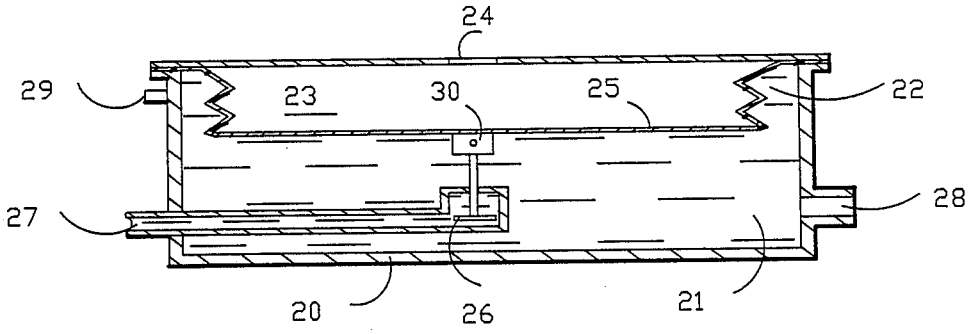
FIG. 2 is a sectional view of a bellow sealing system in a carburetor bowl of an engine.

FIG. 2 shows a floating bellow sealing system installed in the carburetor bowl 20 to isolate the liquid 21 and vapor 22 space from the air space 23 which is vented to the atmosphere through the vent 24. The floating bellow cover 25 has a ball-joint 30 to receive the valve stem of a check valve 26. The rise and fall of the liquid level and hence the floating bellow cover 25 cause the valve 26 to close or open the passage in the inlet tube 27 and maintain a constant fuel level in the bowl while fuel is withdrawn from the bowl through a discharge tube 28. The vapor vent 29 is normally closed and opened only when the fuel fills the carburetor bowl for the first time.

Figure 3:
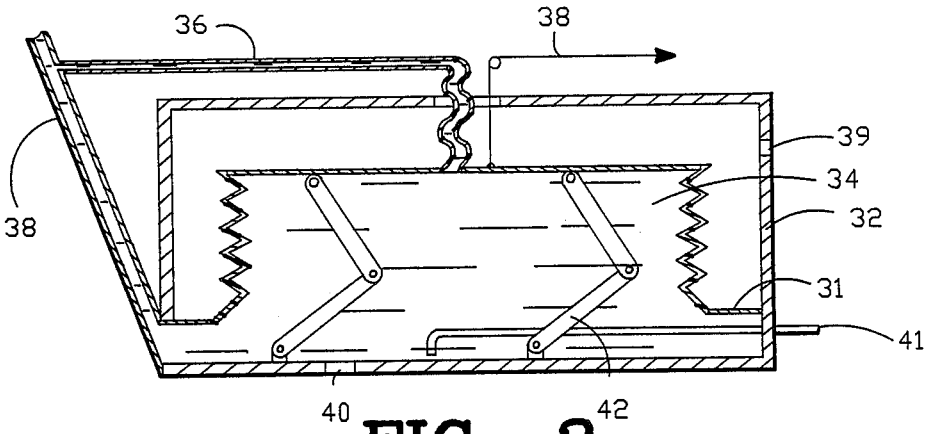
FIG. 3 is similar to FIG. 1, except that the bellow is fixed at the bottom and free at the top and enclosing the liquid.

As an alternative design (FIG. 3), the bellow may have its open-end 31 secured to the lower portion of the storage tank 32 and its closed-end cover 33 riding on the fluid 34 in the bellow. A flexible or recoiled tube 35 and a rigid tube 36 connect the vapor spaces 37 in the bellow and the filler tube 38 to vent the trapped vapors therein during the filling operation. The hydrostatic pressure acting on the underside of the cover 33 is equal to the product of the specific weight of the liquid and the height h of the free surface of the liquid above the underside of the cover 33. The tank has a liquid-level sensing wire 38, air vents 39, a drain plug 40, a pick-up tube 41 and articulate perforated baffle plates 42 inside the bellow and hinge-jointed to the moving cover 33 and the bottom of the tank for damping fluid vibration and sloshing.

Figure 4:
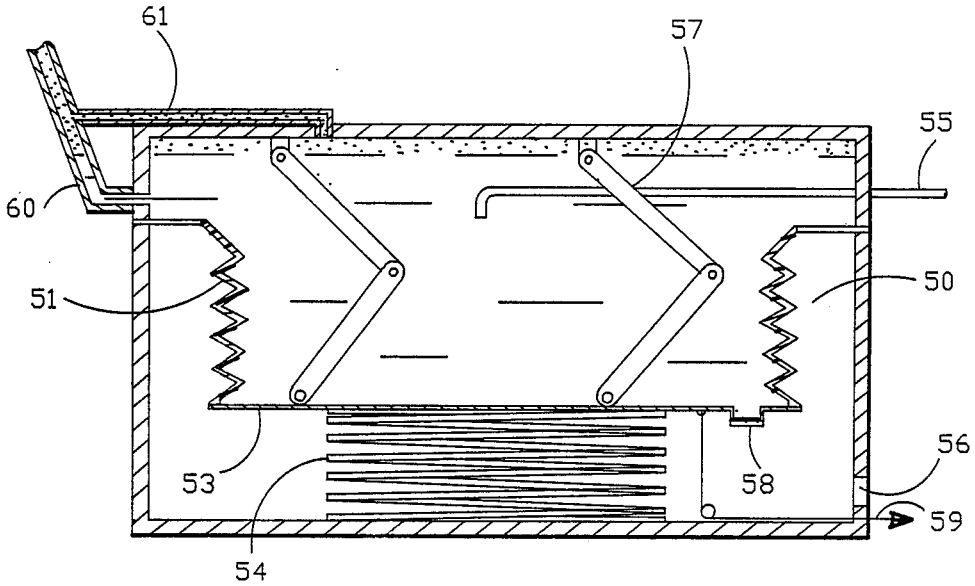
FIG. 4 is similar to FIG. 1, except that the fluid resides inside the spring-supported bellow.

Another alternative (FIG. 4) is to have the fluid 50 and the bottom plate 53 of the bellow 51 supported by a spring 54 or springs. The spring is designed in such a way that the sum of the spring rates of the spring 54 and the bellow is roughly equal to the product of the area of the bottom plate 53 and the specific weight of the liquid. It ensures that the volume of the liquid withdrawn from the bellow through the pick-up tube 55 is equal to the reduced volume of the bellow as a result of the moving-up of the plate 53 of the bellow. Thus, the liquid level is kept at a constant height at all times.

Damping of vibration of the spring supported liquid column is provided by restricted air flow across the vents 56 and by articulate baffle plates 57, which are hinge-jointed to the moving bellow cover 53 and the top of the storage tank. The bellow has a drain plug 58, liquid level sensing wire 59, a filler tube 60 and a cross-over vent tube 61.

Figure 5:
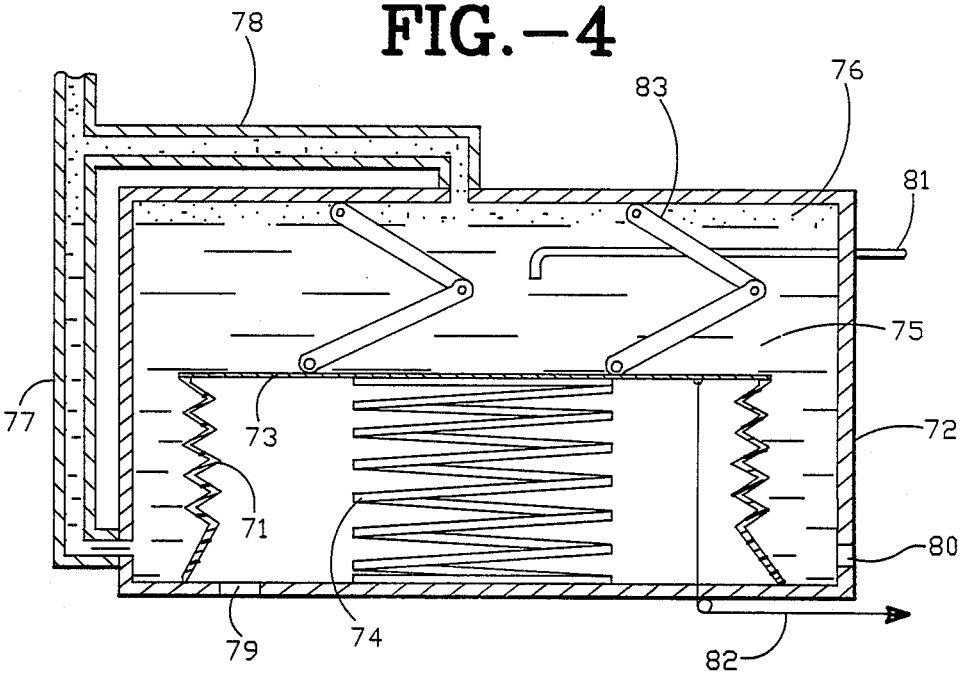
FIG. 5 is similar to FIG. 1 except that the fluid resides outside a spring-supported bellow.

A third alternative design is shown in FIG. 5 in which the bellow 71 is secured to the bottom of the storage tank 72 and its top cover 73 is supported on a spring 74 or springs. The fluid 75 fills the space between the outside of the bellow and the inside of the tank, allowing enough vapor space 76 at the top for thermal expansion and vibration of the fluid column. The spring or springs has the same characteristics as the one in FIG. 4 for keeping a constant liquid level in the tank. The tank has a submerged filler tube 77, vent holes 79 in the bottom of the tank, a drain plug 80, a cross-over vent tube 78 connecting the vapor spaces in the bellow and the filler tube, pick-up tube 81, a liquid level sensing wire 82 and articulate baffle plates 83 hinge-jointed to the moving bellow and the top of the tank for damping fluid vibration and sloshing.

The last two designs (FIGS. 4 and 5) are capable of maintaining a constant liquid level or hydrostatic head in the storage tank. They can be used to produce a constant rate of flow in a gravity feeding storage tank.

Although the bellow sealing system is originally intended for controlling vapor emissions from storage tanks containing volatile liquids, such as gasoline, methanol, propane, etc., it can also be used for eliminating or reducing vapor emissions from tanks containing pressurized or liquefied fluids if heavy duty metal bellows are used, sometimes aided by spring to counteract the high pressures in the storage tanks.

The basic concept of the bellow sealing system can readily be used, with minor design modification, for the development and production of liquid storage tanks having various sizes, shapes, mobile and stationary, ranging from one-gallon portable cans, fuel tanks for motor vehicles, boats and aircrafts, to underground and giant above the ground fuel and chemical storage tanks, etc..

The invention offers a simple, compact and reliable device for minimizing the vapor forming space in the tank, isolating the liquid and vapors from vented air space and keeping the pressure inside the tank constantly at atmospheric conditions at all times. Thus, it effectively eliminates the evaporative losses of unused fuels and chemicals, reduces air pollution, avoids fire and explosion hazards, etc..

It should be understood that the invention is not limited to the specific embodiments disclosed above. Various changes in the construction and arrangements of the bellow sealing system may be made within the scope of the invention.

What is claimed is:

1. A liquid storage tank with evaporate emission control including a bellow having an opened and a closed end;

means for securing the open end to the top of said tank with the closed end adapted to float on the surface of liquid in said storage tank;

said bellows serving to divide the interior of said tank into an externally vented air space and a closed liquid and vapor space including space reserved for thermal expansion of the vapors;

means for admitting fluid into said closed liquid and vapor space; and a bellow-actuated check valve associated with said liquid admitting means for controlling the flow of liquid into said closed liquid and vapor space.

2. A liquid storage tank with evaporative emission control including a bellow having an open and a closed end;

means for securing the open end of the bellow to the top of said tank with the closed end adapted to float on the surface liquid in said storage tank;

said bellow dividing the interior said tank into an externally vented air space and a closed liquid and vapor space including a space reserve for thermal expansion of the liquid and vapors; and articulated baffle plates flexibly attached between the bellow and said tank in the liquid vapor space for damping fluid vibrations and sloshing.

3. A liquid storage tank as in claim 2 including springs for supporting the closed end of said bellows.

4. A liquid storage tank as in claim 2 including a filler tube for admitting liquid into said liquid vapor space without causing splashing and fuming, and a tube connecting the vapor space in said liquid and vapor space to said tube for venting and pressure equalization during filling.

5. A liquid storage tank with evaporative emission control including a bellow having an open and a closed end;

means for securing the open end of the bellow to the bottom of said tank with the closed end resting on top of fluid inside of said bellow;

said bellow dividing the interior of the tank into an externally vented air space and a closed liquid and vapor space including space reserve for thermal expansion of the liquid and vapors; and articulated baffle plates flexibly attached to the bellows between the bellow and tank in the liquid vapor space for damping fluid vibrations and sloshing.

6. A liquid storage tank as in claim 5 in which the closed end is supported on springs.

* * * * *